US005085169A

United States Patent [19]

Okuda et al.

[11] Patent Number: 5,085,169

[45] Date of Patent: Feb. 4, 1992

[54] METHOD OF AND APPARATUS FOR APPLYING A PAINT

[75] Inventors: Shinji Okuda, Hyogo; Hiroshi Maeda; Tsuyoshi Nagata, both of Osaka, all of Japan

[73] Assignee: Sunstar Engineering Inc., Osaka, Japan

[21] Appl. No.: 438,343

[22] Filed: Nov. 16, 1989

[30] Foreign Application Priority Data

Nov. 28, 1988 [JP] Japan ..... 63-155489[U]
Nov. 28, 1988 [JP] Japan ..... 63-301647
Nov. 28, 1988 [JP] Japan ..... 63-301648

[51] Int. Cl.[5] ..... B05C 1/00

[52] U.S. Cl. ..... 118/205; 118/264; 118/265; 118/266; 118/207; 118/269; 427/284; 427/429

[58] Field of Search ..... 118/264, 265, 266, 207, 118/269, 264, 205; 427/429, 284

[56] References Cited

U.S. PATENT DOCUMENTS 4,031,853 6/1977 Conrad ..... 118/264
4,601,918 7/1986 Zaman et al. ..... 427/264
4,660,501 4/1987 Nagata et al. ..... 118/266

*Primary Examiner*—David A. Simmons
*Assistant Examiner*—George A. Goudreau
*Attorney, Agent, or Firm*—Koda and Androlia

[57] ABSTRACT

A method of and an apparatus for applying a paint, wherein elastic paint-coating means capable of being soaked with a paint are used. The paint-coating means are soaked with a paint and moved along the surfaces of an object to be coated with the paint while being pressed against these surfaces. The paint-coating means are mounted on the main bodies of paint-coating members, which are moved alternately to a first prescribed position where a paint-supplying means is disposed and to a second prescribed position where the object to be coated with the paint is disposed. When the paint-coating members are closed in the first prescribed position so as to hold the paint-supplying means between the paint-coating means, the paint-coating means are pushed against the paint-supplying means so that the paint may soak into the paint-coating means.

4 Claims, 9 Drawing Sheets

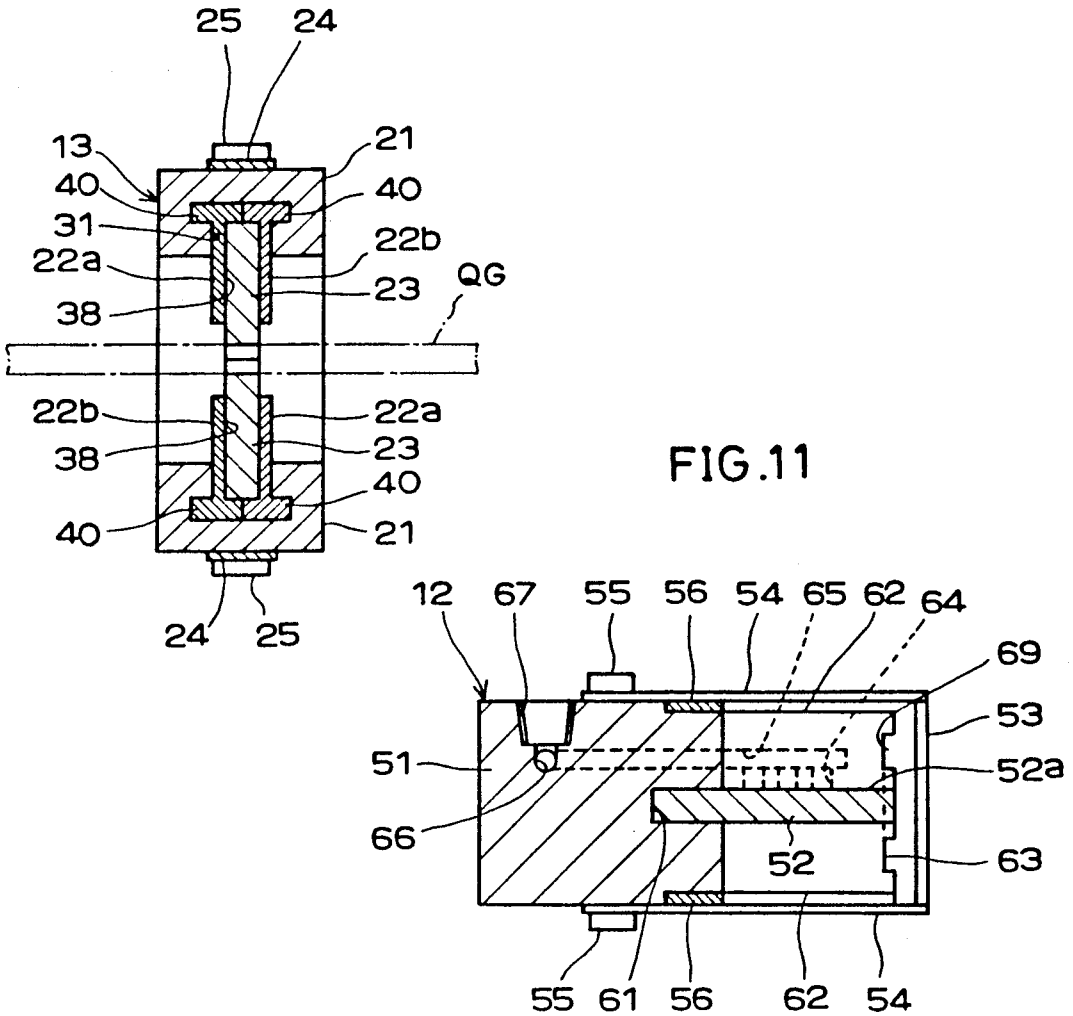
FIG.5
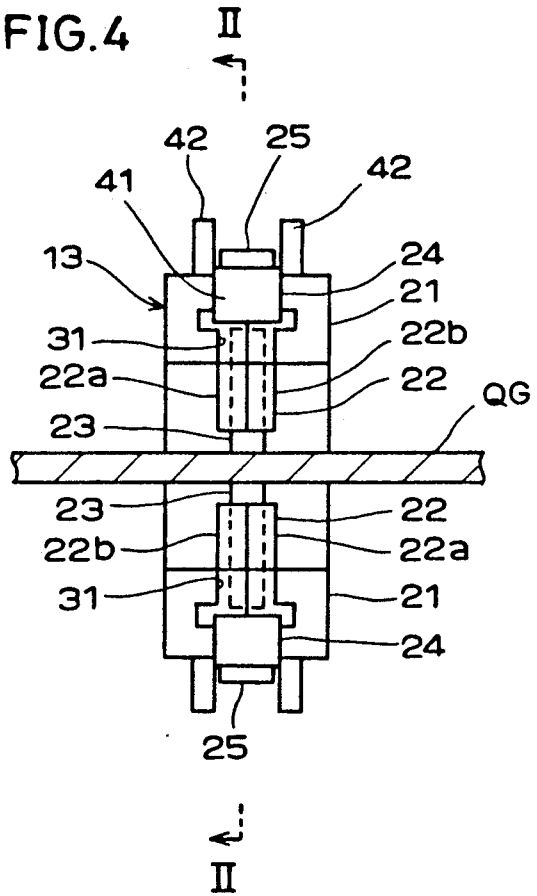
FIG.4
FIG.11

METHOD OF AND APPARATUS FOR APPLYING A PAINT

BACKGROUND OF THE INVENTION

The present invention relates to a method of and an apparatus for applying a paint such as a primer, coating material or adhesive.

In order to apply a paint, it is most common either to soak a paint-coating brush with the paint and move the brush while pushing it against the surface of an object to be coated with the paint or to move a nozzle while discharging or spraying the paint therefrom, with the nozzle tip kept away from the surface of the object by a certain distance.

For example, when hinges are to be mounted on the portions G1 and G2 (FIG. 14) of a quarter window glass QG in an automobile manufacturing plant, brushing has been used for applying a black primer BP to the upper surface F1 (FIG. 1), lower surface F2 and end face F3 in the portions G1 and G2.

Consequently, the application of the black primer to each of the portions G1 and G2 has to consist of three steps of motion to which the brush is subjected relative to the quarter window glass QG. Moreover, the quarter window glass QG has to be turned over when the brush has completed the first step of motion, and the attitude of the quarter window glass QG has to be changed when the brush has completed the second step of motion. This requires a great deal of time and labor.

Another trouble is that uniform paint coating within a prescribed range cannot be easily done, that the coat of the paint cannot be made constant in pattern, and that the paint is applied also to areas where it need not be applied. The result is that the paint is wasted, and the workmanship of paint coating lacks consistency. External appearance goes bad because of these troubles, which are caused by the fact that the brush makes a different path every time it is subjected to reciprocating motion.

In order to soak a paint-coating brush with the paint, it is most common (1) to steep the brush in a vessel which contains the paint, (2) to connect a pipe to the root portion of the brush so that the paint may be supplied to the brush through the pipe, or (3) to fixedly mount a paint reservoir on the brush. In the first case, the quantity of the paint with which the brush is soaked cannot be kept constant. Consequently, stringiness or trickling of the paint is liable to occur, and uniform paint coating cannot be done. In the second case, a paint feed pump and the brush must be connected with each other by means of a flexible pipe if the continuous feed of the paint is to be effected. This construction makes it difficult to precisely control the flow of the paint. In the third case, it is not easy to cut off the supply of the paint, and the paint reservoir must be replaced with a new one every time the old one is emptied.

In case where the paint is discharged from a nozzle, it is necessary to precisely control the quantity of the paint discharged per unit time from the nozzle, because the coating thickness is determined thereby. However, it is not easy to precisely control such a quantity.

SUMMARY OF THE INVENTION

Under these circumstances, it is an object of the present invention to provide a method of and an apparatus for applying a paint to two or more surfaces, at a time, of an object to be coated with the paint so that the time required for application may be reduced and the paint-coating pattern may be made constant.

It is another object of the present invention to provide an apparatus for supplying the paint, wherein the flow of the paint can be so easily subjected to a precise control that the paint can be applied uniformly and stringiness or trickling of the paint does not occur when the paint has been applied to the surfaces of the object.

The present invention, in which elastic paint-coating means capable of being soaked with a paint are used, is characterized in that the paint-coating means are soaked with a paint and moved along the surfaces of an object to be coated with the paint while being pressed against these surfaces. Each paint-coating means includes a plane surface coating portion adapted to be pressed against the upper or lower surface of the object and an end face coating portion adapted to be pressed against the end face of the object. Paint-coating members are provided respectively with main bodies, on each of which the above-described paint-coating means is mounted. A manipulator alternately moves the paint-coating members to a prescribed position where a paint-supplying means is disposed and to another prescribed position where the object to be coated with the paint is disposed. When the paint-coating members are closed in the former position so as to hold the paint-supplying means between the paint-coating means, the paint-coating means are pushed against the paint-supplying means so that the paint may soak into the paint-coating means. When the paint-coating members are closed in the latter position so as to hold the object between the paint-coating means, the paint-coating means are pressed against the object and moved along the edge of the object so that the paint may be applied to the surfaces of the object.

A preferred embodiment of the present invention is hereinafter described with reference to the accompanying drawings.

BRIEF DESCRIPTION OF THE DRAWINGS

FIG. 4 is a side view of the paint-coating members as viewed in the direction of an arrow IV in FIG. 1;

FIG. 5 is a cross section taken along line V—V of FIG. 1;

FIG. 11 is a cross section taken along line XI—XI of FIG. 7;

DETAILED DESCRIPTION OF THE INVENTION

Figure 14:
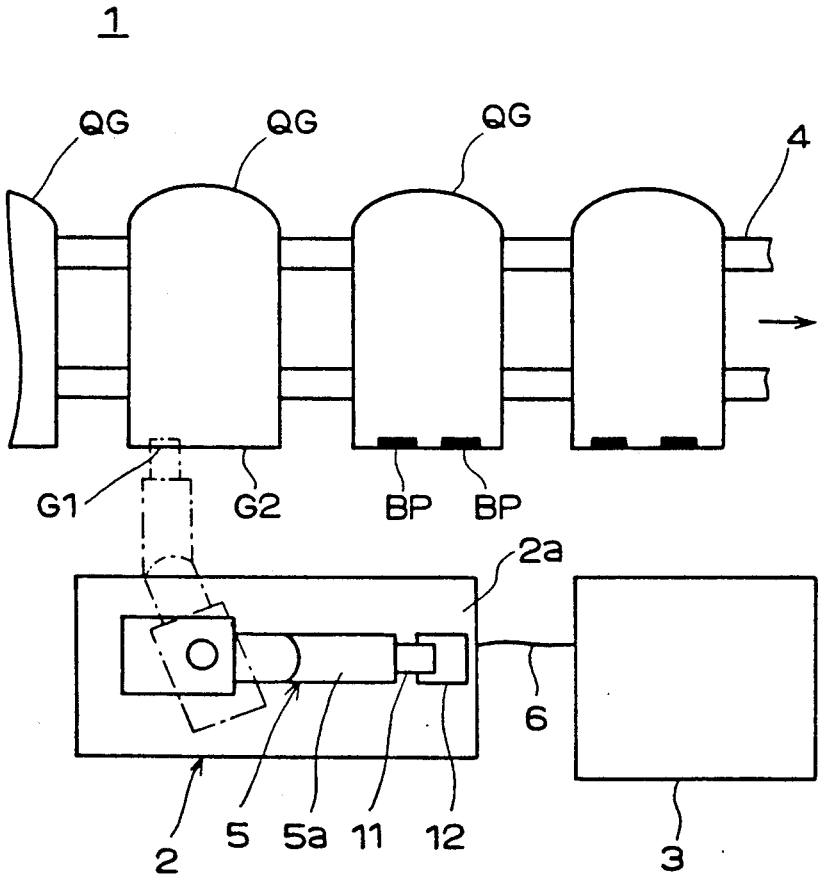
FIG. 14 is a plan view, giving a rough idea about the construction of a paint-coating system according to the present invention.

Referring now to FIG. 14, the paint-coating system 1 consists of a paint-coating installation 2, a paint-supplying apparatus 3 and a conveyer 4. The paint-coating installation 2 in turn consists of a paint-coating unit 11, a paint-supplying member 12 and a paint-coating robot 5 capable of moving the paint-coating unit 11 by means of a manipulator 5*a*. The conveyer 4 carries one quarter window glass QG after another and stops in a position prescribed for allowing the paint-coating installation 2 to apply the paint to the prescribed portions of the quarter window glass QG.

Figure 1:
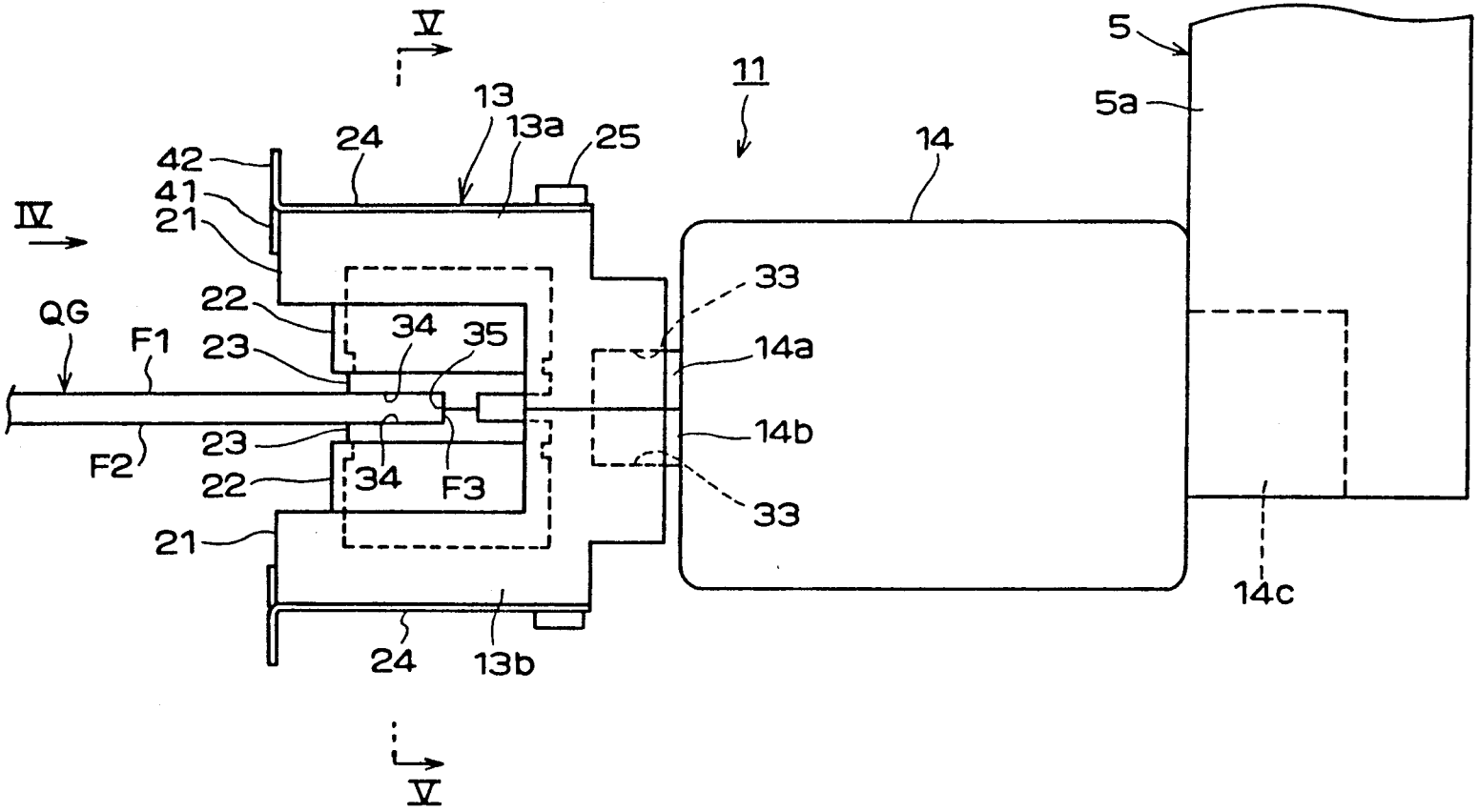
FIG. 1 is a front view of a paint-coating unit according to the present invention.

Referring now to FIG. 1, the paint-coating unit 11 consists of paint-coating members 13 and a vertically driven chuck 14. The paint-coating members 13 comprise an upper member 13*a* and a lower member 13*b*, which are moved in the vertically opposite directions by means of the vertically driven chuck 14.

The vertically driven chuck 14 is of known construction in that it has a built-in air cylinder, to which compressed air is supplied so as to drive an upper finger 14*a* and a lower finger 14*b* in the vertically opposite directions. The vertically driven chuck 14 has a mounting neck 14*c* for attaching the chuck 14 to the end portion of the manipulator 5*a* by means of a bolt or the like (not shown). Paint-coating felt elements 23 are raised and lowered by means of the vertically driven chuck 14 so as to be a great convenience to the application of a paint to an object having parallel surfaces. In this embodiment, an example of such an object is given in the form of a quarter window glass QG.

The upper member 13*a* and the lower member 13*b*, of which the paint-coating members 13 consist, have an identical construction and, therefore, an explanation will be directed only to the upper member 13*a*, with the understanding that this explanation is applicable to the lower member 13*b* unless indicated otherwise.

Referring now to FIGS. 2 to 5, the upper member 13*a* consists of a main body 21, a paint-coating felt element 23, a felt element holder 22 and a keeper plate 24.

Figure 2:
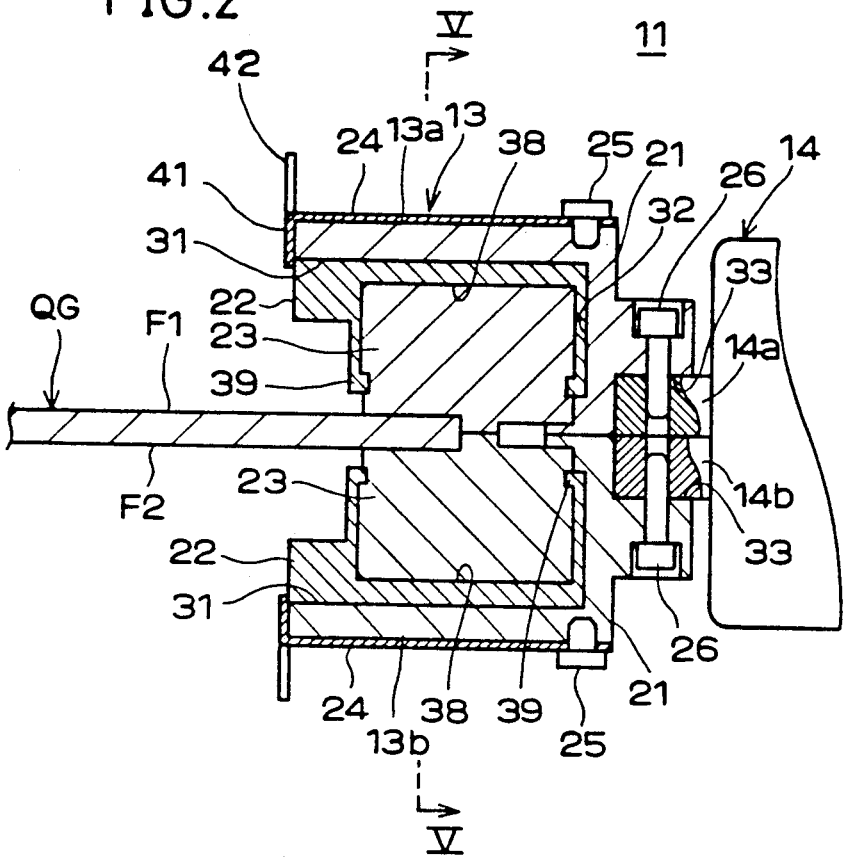
FIG. 2 is a vertical section of the paint-coating members included in the paint-coating unit shown in FIG. 1.

The main body 21 comprises a substantially L-shaped member made of a metal. Grooves 31 and 32 for attaching the felt element holder 22 to the inner surface of the main body 21 are formed in such a manner that the groove 31 is of T-shaped cross-section and reaches down to the groove 32. The upper finger 14*a* of the vertically driven chuck 14 is affixed to a recess 33 formed in one end of the main body 21 and locked therein by means of a bolt 26. When the vertically driven chuck 14 is closed, the main body 21 of the upper member 13*a* comes in contact with that of the lower member 13*b* as shown in FIGS. 1 and 2.

The paint-coating felt element 23 is a flat board of compressed felt formed into a prescribed shape. It is porous, elastic, and capable of being soaked with a black primer BP. However, elasticity required of the paint-coating felt element 23 need not be identical with that which is required, e.g., of a metal spring. The paint-coating felt element 23 has only to be capable of remaining in a certain shape when it is put in a free state, being deformed when it is pressed against the surface of the quarter window glass QG, and returning substantially to its original shape after it is detached from the surface of the quarter window glass QG.

Figure 3:
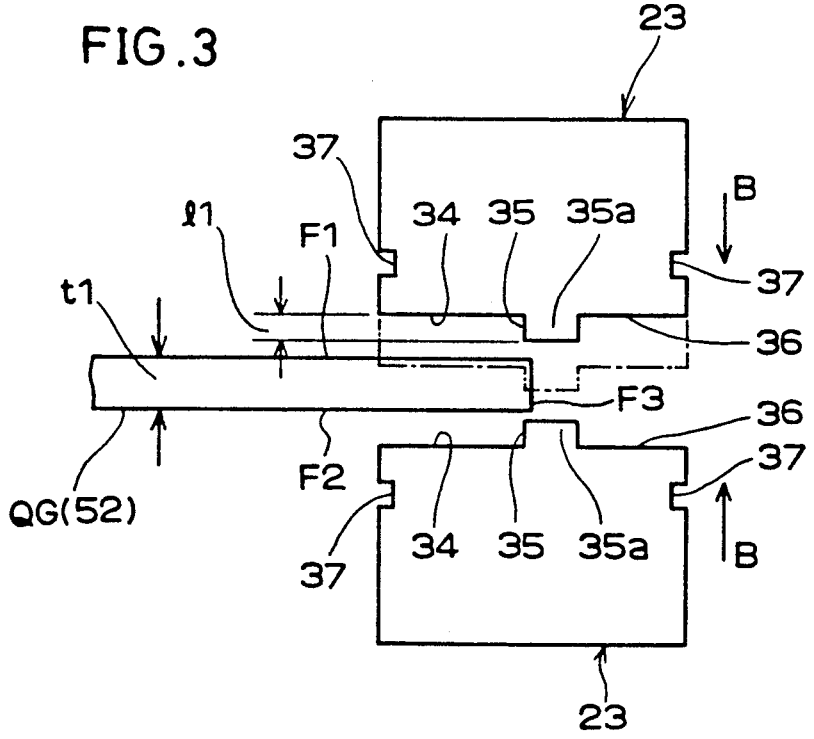
FIG. 3 is a front view of a paint-coating felt element.

An edge of the paint-coating felt element 23 is allotted for coming in contact with the quarter window glass QG. As shown in FIG. 3, this edge is formed with a plane surface coating portion 34 adapted to be pressed against the upper surface F1 or the lower surface F2 and an end face coating portion 35 adapted to be pressed against the end face F3. The end face coating portion 35 is adjacent to the plane surface coating portion 34 and projects by l1 therefrom so as to form a projecting portion 35*a*. The dimension l1 is equal to the half of the thickness t1 of the quarter window glass QG. In order to impart flexibility to the projecting portion 35*a*, a shoulder 36 extends laterally from the side of the projecting portion 35*a* opposite the side defining the plane surface coating portion 34. Both side edges of the paint-coating felt element 23 are provided with keeper sockets 37, into which detents are allowed to fit to hold the paint-coating felt element 23 in position.

When the vertically driven chuck 14 is open, the paint-coating felt element 23 does not make contact with the quarter window glass QG as will be seen in FIG. 3. Starting from this position, the upper and lower fingers of the vertically driven chuck 14 move in the directions indicated by arrows B. If it were not for the quarter window glass QG, the plane surface coating portion 34 and the end face coating portion 35 of the paint-coating felt element 23 attached to the upper member 13*a* would reach down to such a position as shown in phantom lines in FIG. 3. In the presence of the quarter window glass QG, its upper surface F1 and end face F3 encroach upon the portions 34 and 35 by about one millimeter. In other words, the portions 34 and 35 yield to the upper surface F1 and end face F3 of the quarter window glass QG. Since the paint-coating felt element 23 attached to the lower member 13*b* is raised simultaneously with the downward motion of the paint-coating felt element 23 attached to the upper member 13*a*, the end portions of the two projecting portions 35*a* come in contact with each other and yield to each other.

The paint-coating felt element 23 may be made of a porous material such as cotton, cloth, sponge, or cotton covered with cloth.

As shown best in FIG. 5, the felt element holder 22 is divided into two symmetrical pieces 22*a* and 22*b*, which are made, e.g., of a synthetic resin and formed with a recess 38 for receiving the paint-coating felt element 23. The pieces 22*a* and 22*b* are further provided with detents 39 (FIG. 2) fitting into the keeper sockets 37 formed in the paint-coating felt element 23 to hold it in position. As mentioned above, the groove 31 formed in the main body 21 is of T-shaped cross-section, whereby shoulders are provided, on which the outward flanges 40 of the pieces 22*a* and 22*b* are allowed to rest so that the pieces 22*a* and 22*b* may be prevented from vertically coming out of the groove 31.

The keeper plate 24 made of a sheet metal is secured to the main body 21 by means of a bolt 25. The middle portion of the free edge of the keeper plate 24 is bent to terminate in a clamping end 41, which abuts against the end face of the felt element holder 22 so that the felt element holder 22 may be prevented from horizontally coming out of the groove 31. Both end portions of the free edge of the keeper plate 24 are bent in the direction opposite to the clamping end 41 to form manual control knobs 42. The felt element holder 22 can be taken off merely by pinching the manual control knobs 42 and backing them off until the clamping end 41 makes way sufficiently to pass the felt element holder 22.

The construction of the paint-coating members 13 is such that, when the upper member 13*a* and the lower member 13*b* are closed by the vertically driven chuck 14, two paint-coating felt elements 23 attached respectively to these members 13*a* and 13*b* are pressed against the upper surface F1, lower surface F2 and end face F3 of the quarter window glass QG. Then the paint-coating unit 11 is moved by means of the manipulator 5*a* along the edge of the quarter window glass QG so that the black primer BP may be applied to the portions G1 and G2.

Referrence will now be specifically made to the paint-supplying member 12 (FIG. 6) by which the black primer BP is supplied to the paint-coating members 13.

Referring now to FIGS. 7 to 11, the paint-supplying member 12 includes a main body 51, a paint-supplying felt element 52, covers 53 for the paint-supplying felt element 52, keeper plates 54 for the covers 53, and packings 56.

The main body 51 comprises a substantially U-shaped member made of a metal. A groove 61 for fitting the paint-supplying felt element 52 therein is formed in the middle portion of the inner surface of the main body 51. Recesses 62 for attaching the packings 56 thereto are formed in the upper and lower surfaces in the inner edge portions of the main body 51. U-shaped grooves 63 for attaching the covers 53 are symmetrically formed in the lower end faces as viewed on FIG. 8.

Figure 8:
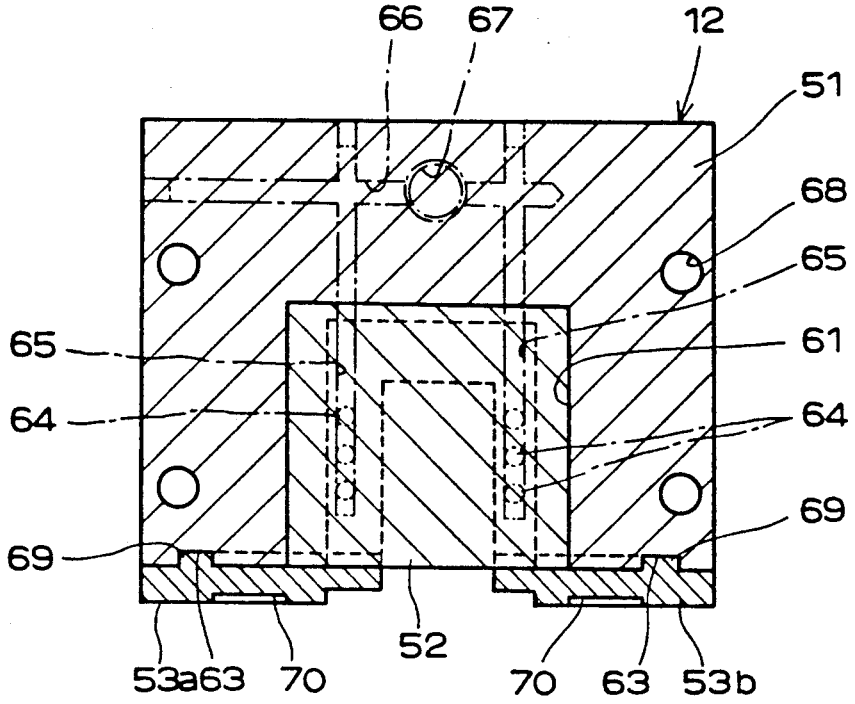
FIG. 8 is a horizontal sectional view of the paint-supplying member shown in FIG. 7.
Figure 10:
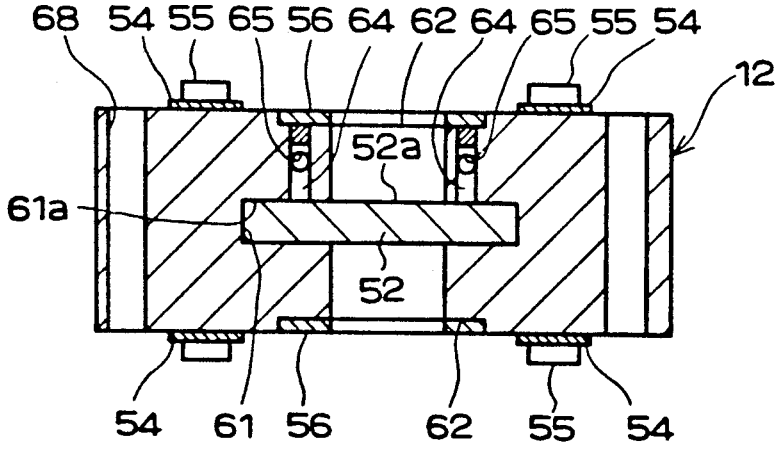
FIG. 10 is a cross section taken along line X—X of FIG. 7.

As shown best in FIGS. 8 and 10, a plurality of orifices 64 have openings in the upper surface 61*a* of the groove 61. The orifices 64 communicate with a port 67 through passages 65 and 66. The orifices 64 and the passages 65 and 66 can be easily formed by boring holes in the main body 51 to the extent of attaining suitable depths and by stopping these holes with blank caps.

The inside diameter of the passages 65 is equal to that of the passage 66, while the inside diameter of the orifices 64 is about one-half as large as that of the passages 65. Consequently, the black primer BP supplied from the port 67 flows out of the orifices 64 at a substantially uniform injection pressure.

The numeral 68 refers to mounting holes.

The paint-supplying felt element 52 is made of a material similar to that of which the paint-coating felt element 23 is made. Alternatively, the former material is softer than the latter and spongy. The paint-supplying felt element 52 is in the shape of a square board, which is equal in thickness to the quarter window glass QG and conforms closely to the groove 61 formed in the main body 51.

The covers 53, the aim of which is to prevent the paint-supplying felt element 52 from coming out of the groove 61, consist of two pieces 53*a* and 53*b* having an identical construction. Each of them is provided with a U-shaped rib 69, which conforms closely to the U-shaped groove 63 so as to be adapted to fit into it. Each of the pieces 53*a* and 53*b* is provided also with a vertical groove 70, into which the clamping end of the keeper plate 54 for the cover 53 is allowed to fit.

The keeper plates 54, which are secured to the upper and lower surfaces of the main body 51 by means of bolts 55, are similar to the keeper plate 24 (FIG. 1) in that they are made of a sheet metal. The free edge of each keeper plate 54 is bent at right angles to terminate in a clamping end 71, which fits into the vertical groove 70 and thereby prevents the piece 53*a* or 53*b* from falling off.

Figure 12:
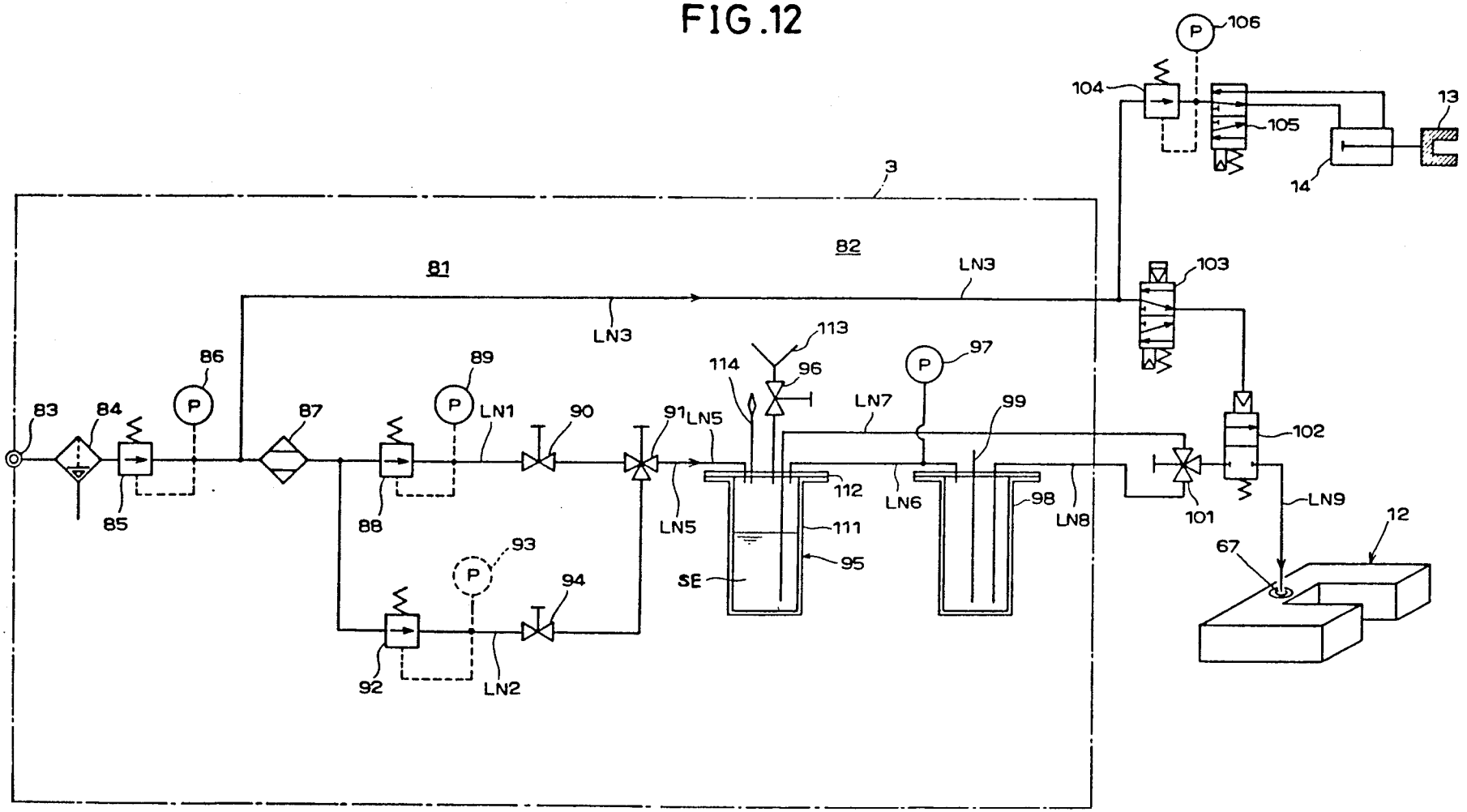
FIG. 12 is a diagramatic view of fluid flow lines incorporating an apparatus for supplying the paint.

The paint-supplying member 12 (FIG. 6) is secured to a mounting block 15, which in turn is mounted on a base member 2*a* for the paint-coating installation 2. In the present instance, the main body 51 of the paint-supplying member 12 is held in place by bolts (not shown) threaded into the top of the block 15 through holes 68 (FIG. 7) formed in the main body 51. A pipe for supplying the black primer BP is connected at one end to the port 67 and at the other end to the paint-supplying apparatus 3 (FIG. 12).

The black primer BP supplied to the port 67 flows through the passages 66 and 65, flows out of the orifices 64 at a substantially uniform injection pressure, penetrates into the paint-supplying felt element 52, and is diffused therein. If more black primer BP than the paint-supplying felt element 52 can hold is supplied, the extra black primer BP inundates the exposed portion 52*a* of the upper surface of the paint-supplying felt element 52 and then soaks either into the element 52 or into the paint-coating felt elements 23 holding the element 52 therebetween.

Thus the whole of the paint-supplying felt element 52, instead of its lower portion alone, is soaked with the black primer BP. Especially the exposed portion 52*a*, which comes in contact with the paint-coating felt elements 23, is soaked with a sufficient quantity of the black primer BP.

Reference will now be specifically made to the paint-supplying apparatus 3 for supplying the black primer BP to the paint-supplying member 12.

Referring now to FIG. 12, the paint-supplying apparatus 3 consists of a controlling means 81 for supplying clean air at a suitably controlled pressure and a paint-supplying means 82 for supplying the black primer BP under air pressure.

The controlling means 81 consists of an air inlet 83 connected to a compressor (not shown), an automatic drain filter 84, a regulator 85 for the coarse control of air pressure, a pressure gauge 86, an air dryer 87 for the dehumidification of air, regulators 88 and 92 for the precision control of air pressure in an ordinary air line LN1 and a clean air line LN2 respectively, pressure gauges 89 and 93, stop valves 90 and 94, and a change-over valve 91 for making a switchover of compressed-air supply from the line LN1 to the line LN2 and vice versa.

The paint-supplying means 82 consists of a tank 95 containing an antihardening agent SE, a stop valve 96, a pressure gauge 97, a tank 98 containing the black primer BP, and a primer level detecting sensor 99 for detecting the primer level in the tank 98.

The air dryer 87 lowers the temperature of hot air fed thereto, discharges the condensed water, and lowers the dew point to, e.g., about 70° C. below zero so that dew condensation may not occur in the lower reaches of the line. The air dryer 87 is of known construction in that it includes a prefilter, final filter and automatic water trap in addition to a heat exchanger as the major equipment. The provision of the air dryer 87 precludes the possibility that the black primer BP is hardened as a result of acting upon water. Special pipe laying and the replacement of high-pressure tanks filled with high-pressure nitrogen gas, which would be required if high-pressure nitrogen gas were used as is the case with conventional air dryers, are no longer required. Because of its small pressure differential, the air dryer 87 is capable of subjecting the air pressure to precision control. Since only a small flow of the black primer BP is required for application to an object to be coated therewith, even a small-sized air dryer 87 can be of use and, consequently, the paint-supplying apparatus 3 can be made compact.

As shown in FIG. 12, the cylindrical main body 111 of the tank 95 is put in a sealed condition by a lid 112. A compressed air pressure supplied through an air line LN5 is applied to the interior of the tank 95 so that the antihardening agent SE contained therein may be delivered to an antihardening agent line LN7. The compressed air supplied to the tank 95 flows out through an air line LN6 and is admitted into the tank 98. In order to replenish the tank 95 with the antihardening agent SE, the stop valve 96 is opened so that the antihardening agent SE in a hopper 113 may be admitted into the tank 95. The numeral 114 refers to a safety valve.

Figure 13:
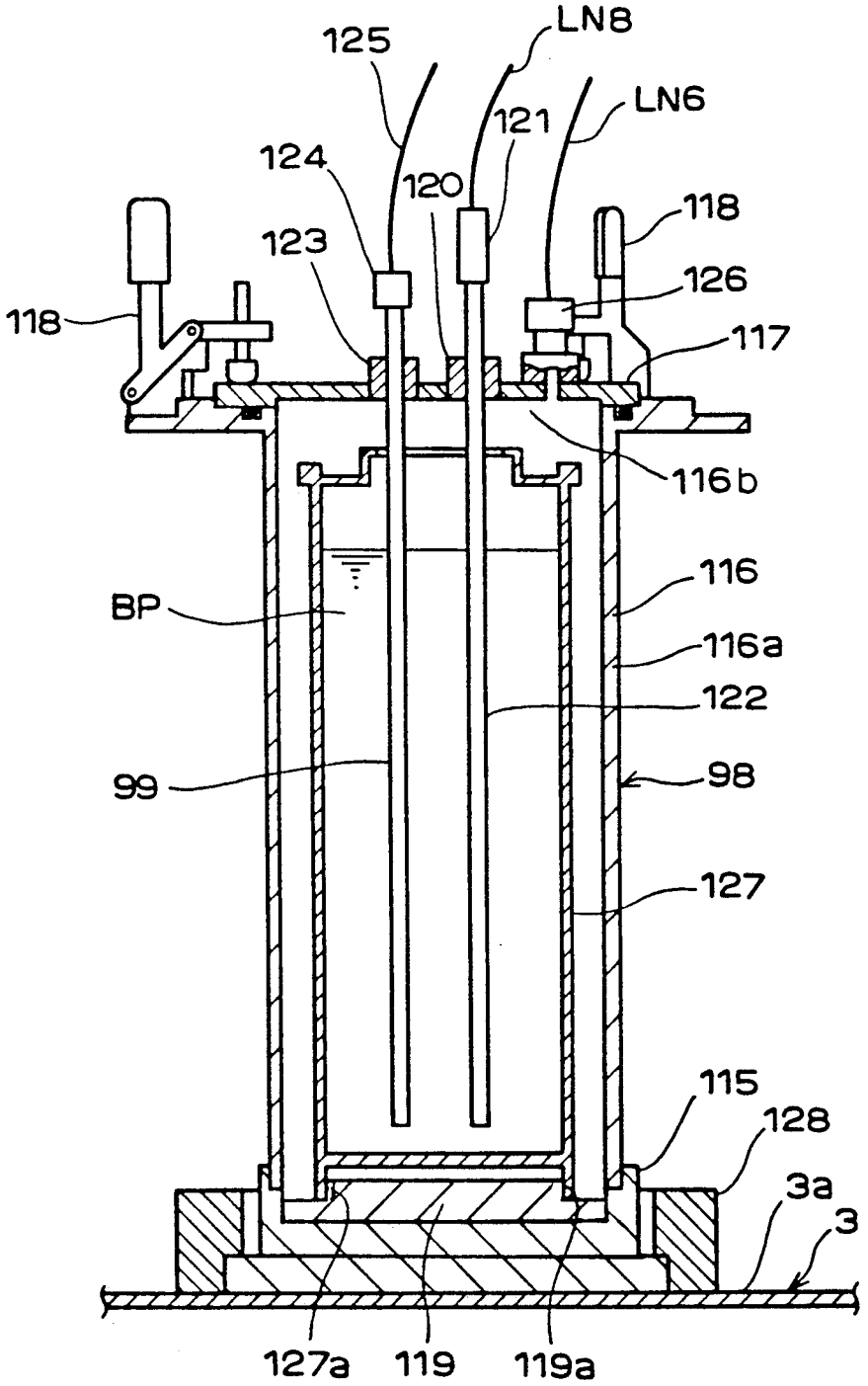
FIG. 13 is a vertical section of a primer tank.

As shown in FIG. 13, the main body 116 of the tank 98 consists of a baseplate 115 and an outer casing 116*a* fixedly mounted on the baseplate 115. The open top of the main body 116 is put in a sealed condition by a lid 117 demountably mounted thereon by means of clamps 118.

A base member 119 made of a synthetic resin or the like is disposed on the upper surface of the baseplate 115. The upper half of the base member 119 provides a smaller compass than the lower half, whereby a shoulder 119*a* is formed to provide a seat for allowing a cartridge type primer vessel 127 to bear upon it in such a manner that the inner surface 127*a* of a flange formed in the lowermost part of the vessel 127 abuts against the cylindrical surface of the shoulder 119*a*. Before the vessel 127 filled with the black primer BP is inserted into the main body 116, a cap is removed from the vessel 127.

Bushes 120 and 123 are mounted on the lid 117 and tapped to airtightly engage the threaded portions of a pipe 122 and the primer level detecting sensor 99 respectively. The pipe 122 is connected at one end to a primer line LN8 through a connector 121 and immersed at the other end in the black primer BP. Brackets 128 are used for mounting the tank 98, by means of bolts or the like (not shown), on a plate 3*a* on which the paint-supplying apparatus 3 is mounted.

The internal pressure of the tank 98 increases when a mixture of air and the vaporized antihardening agent SE is admitted into the tank 98 through the air line LN6 connected to the tank 98 by means of a connector 126. The increased pressure is applied to the interior of the primer vessel 127 so that the black primer BP contained therein may be delivered to the primer line LN8 through the pipe 122. The vaporized antihardening agent SE serves to prevent the black primer BP from hardening.

The lower end of the primer level detecting sensor 99 is impregnated with a thermister, with fixed bias applied thereto through a lead wire 125. Consequently, a change in heat radiation caused by a change in the primer level is detected in terms of a change in resistance caused by a change in the temperature of the thermister. When the primer vessel 127 is emptied, the primer level detecting sensor 99 detects the emptiness.

When the primer vessel 127 is emptied, the supply of air through the air line LN6 is cut off and extra pressure is withdrawn from within the tank 98. Then the clamps 118 are loosened and the lid 117 is taken off, and the emptied primer vessel 127 is replaced with a full one.

Thus the tank 98 can be easily replenished with the black primer BP. By giving hard shakes to a new primer vessel 127, the sediment of the black primer BP can be stirred. When the paint-supplying apparatus 3 has been out of use over a long period of time, the primer vessel 127 is taken off from the tank 98 and hard shakes are given to the primer vessel 127 so that the sediment of the black primer BP may be stirred and the black primer BP may be delivered to the primer line LN8 at a uniform concentration, which is a great convenience to the application of the black primer BP to an object to be coated therewith. The enriched black primer BP left at the bottom of the primer vessel 127 is none other than the waste of black primer.

Referring now again to FIG. 12, a change-over valve 101 makes a switchover of line connection from the line LN8 to the line LN7 and vice versa. When a solenoid operated change-over valve 103 is actuated, either the black primer BP from the line LN8 or the antihardening agent SE from the line LN7 is fed to the port 67 of the paint-supplying member 12 through a pilot operated change-over valve 102 and a supply line LN9. The compressed air supplied through the air line LN3 is fed not only to the change-over valve 103 but also to the vertically driven chuck 14 through a regulator 104 and a solenoid operated change-over valve 105. The vertically driven chuck 14 is opened and closed by the on-off control of the change-over valve 105.

The change-over valves 101, 102 and 103 are disposed in the vicinity of the paint-supplying member 12, while the regulator 104, change-over valve 105 and pressure gauge 106 are disposed in the vicinity of the paint-coating robot 5. Therefore, the line 6 (FIG. 14) consists of the air line LN3, antihardening agent line LN7, primer line LN8 and signal conductors.

There shall now be described one utilization of the paint-coating system 1.

Various parts of the fluid flow lines are adjusted to be at a pressure of about 7 $Kg/cm^2$, about 0.1 to 0.5 $Kg/cm^2$ and about 2 $Kg/cm^2$ by means of the regulators 85, 88 and 92 respectively. The change-over valve 91 forms a junction of the ordinary air line LN1 with the air line LN5, while the change-over valve 101 forms a junction of the primer line LN8 with the supply line LN9.

Figure 6:
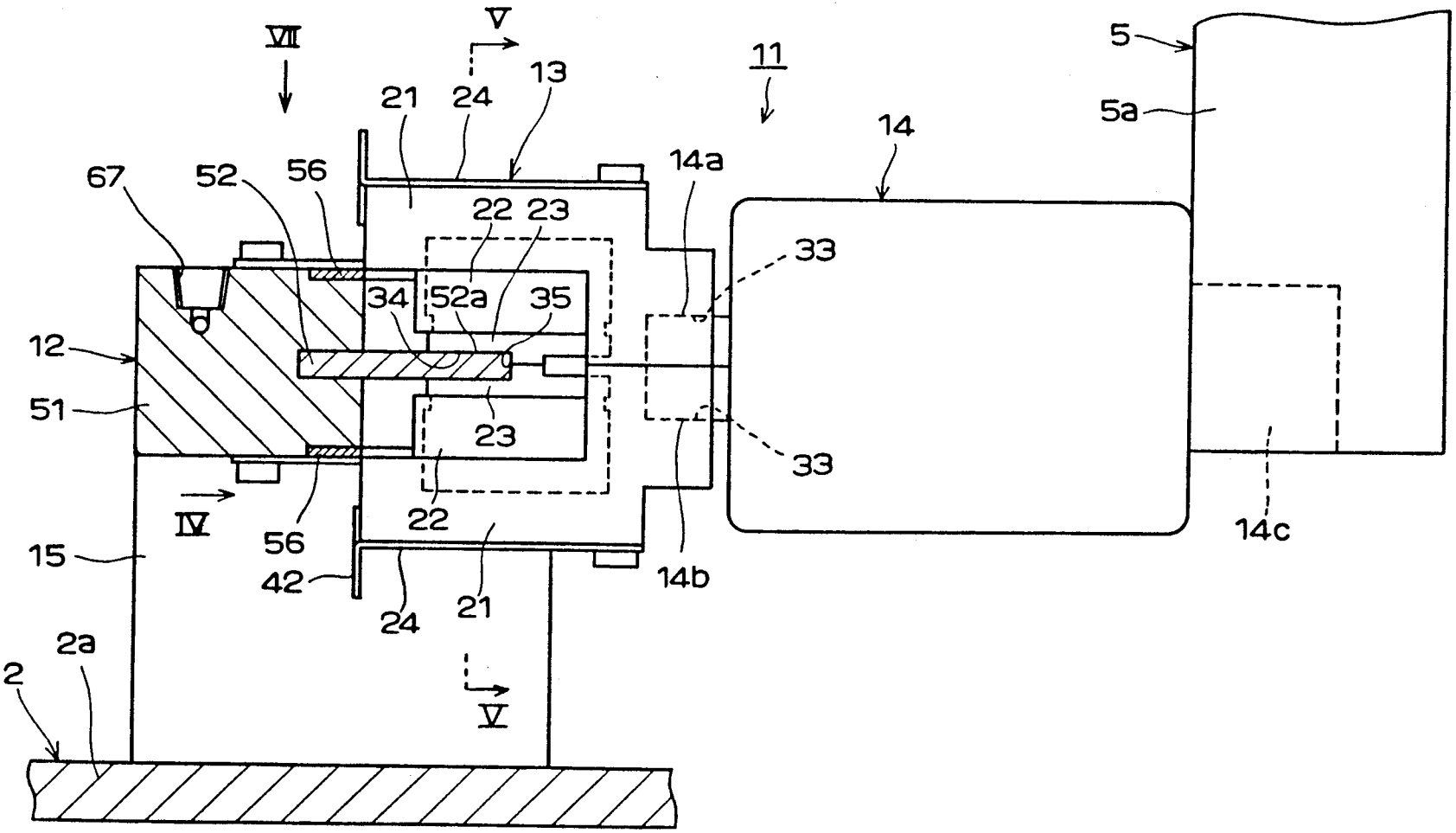
FIG. 6 is a sectional view, illustrating the paint-coating members holding a paint-supplying member therebetween.
Figure 7:
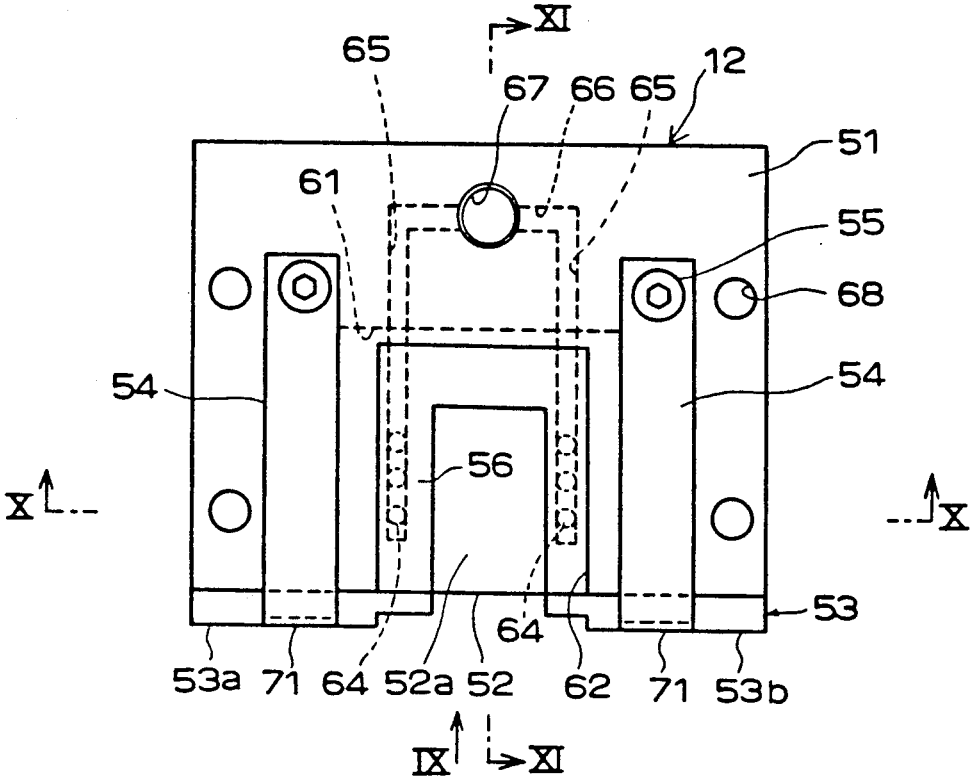
FIG. 7 is a plan view of the paint-supplying member.
Figure 9:
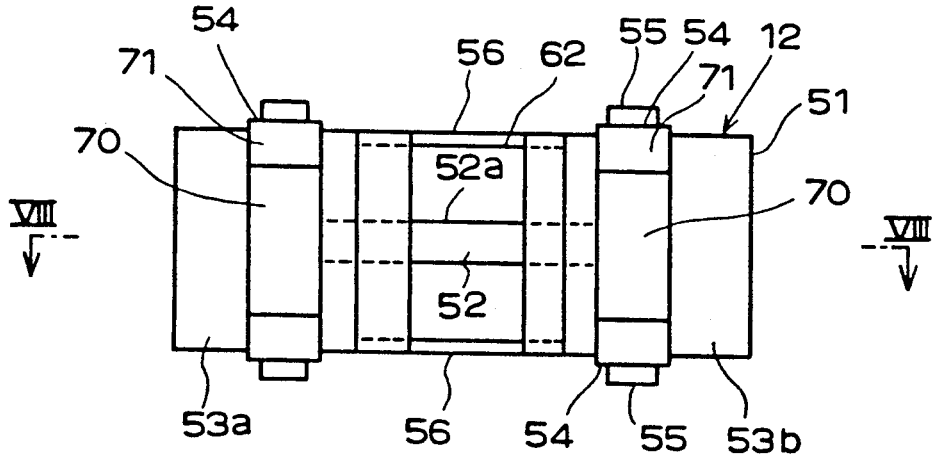
FIG. 9 is a side view of the paint-supplying member as viewed in the direction of an arrow IX in FIG. 7.

The manipulator 5*a* of the paint-coating robot 5 allows the paint-coating unit 11 to come close to the paint-supplying member 12 under the condition that the vertically driven chuck 14 is open. When a signal developed by a detecting element (not shown) causes the change-over valve 105 to make a switchover, the chuck 14 closes as shown in FIG. 6, with the result that the paint-coating felt elements 23 attached to the upper and lower members, of which the paint-coating members 13 consist, hold the paint-supplying felt element 52 of the paint-supplying member 12 between themselves. The contact areas of the paint-coating felt elements 23 and the paint-supplying felt element 52 are compressed when they are pressed against each other. Because of this compressed state, the black primer BP can be easily transferred from the paint-supplying felt element 52 to the paint-coating felt elements 23. The inner surfaces of the main bodies 21 are pressed against the packings 56. Consequently, the paint-supplying felt element 52 and the paint-coating felt elements 23 get out of touch with the ambient air.

Then, for a certain length T1 of time, the change-over valve 102 is put in such a condition that the black primer BP is supplied therethrough to the port 67 in the paint-supplying member 12. Then the black primer BP flows out of the orifices 64, soaks into the whole of the paint-supplying felt element 52, and sufficiently soaks into the paint-coating felt elements 23.

When a certain length T2 of time elapses after the moment when the change-over valve 102 is put out of the above-described condition, the change-over valve 105 makes a switchover so as to open the vertically driven chuck 14. Then the manipulator 5*a* allows the paint-coating unit 11 to come close to the portion G1 of the quarter window glass QG as shown in phantom lines in FIG. 14. Then the vertically driven chuck 14 closes as shown in FIG. 1, with the result that the paint-coating felt elements 23 attached to the upper and lower members, of which the paint-coating members 13 consist, hold the upper surface F1, lower surface F2 and end face F3 of the quarter window glass QG. The plane surface coating portions 34 and the end face coating portions 35 of the paint-coating felt elements 23 yield to the surfaces of the quarter window glass QG and ooze out the black primer BP.

Now the manipulator 5*a* moves the paint-coating unit 11 in parallel with the edge of the quarter window glass QG so that a fixed paint-coating path may be made and the black primer BP may be applied uniformly to the upper surface F1, lower surface F2 and end face F3 of the quarter window glass QG.

The vertically driven chuck 14 is opened when the black primer has been applied to the portion G1. Then the black primer is applied to the portion G2 in the same manner as mentioned above. When the black primer has been applied to the portions G1 and G2, the manipulator 5*a* moves the paint-coating unit 11 to the paint-supplying member 12 again.

The next quarter window glass QG is carried by the conveyor 4 and stopped in a position prescribed for applying the black primer. Then the same operation as mentioned above is repeated.

The quantity of the black primer BP with which the paint-coating felt elements 23 are soaked by means of the paint-supplying member 12 is determined by the quantity of the black primer BP with which the paint-supplying felt element 52 is soaked, i.e., by the quantity of the black primer BP supplied to the port 67. The change-over valve 102 has only to have a fixed "on" period T1 in order to always soak the paint-coating felt elements 23 with a equal quantity of the black primer BP (i.e., in order to always apply an equal quantity of the black primer BP to the quarter window glass QG). The quantity of the black primer BP to be applied to the quarter window glass QG can be easily adjusted by adjusting the length T1 of time.

Conventional apparatuses are attended with difficulties in that the black primer BP must be discharged at a constant rate throughout the operation, because the black primer BP is directly supplied to the surfaces of the quarter window glass QG. The present embodiment is in striking contrast to these conventional apparatuses in that the black primer BP is indirectly supplied, i.e., the paint-coating felt elements 23 of the paint-coating members 13 are interposed between the source of black primer supply and the quarter window glass. In case of this construction, batches of the black primer BP to be supplied to the paint-supplying member 12 can be easily subjected to a precise control so that they may be made equal to each other.

In order to wash the change-over valves 101, 102 and the paint-supplying member 12, the clean air line LN2 is connected to the air line LN5 by a switchover effected in the change-over valve 91, and the antihardening agent line LN7 is connected to the supply line LN9 by a switch-over effected in the change-over valve 101.

Then a compressed air pressure is applied to the interior of the tank 95 so that the antihardening agent SE contained therein may be delivered to the equipment such as the change-over valves 101 and 102. The black primer BP, etc. sticking to the equipment are thereby washed away so that the occurrence of blinding and malfunction may be prevented. In order to wash the primer line LN8, the primer vessel 127 in the tank 98 may be replaced with a vessel containing the antihardening agent SE.

In the above-described preferred embodiment, the paint-coating pattern can be made constant and the black primer can be applied to two or more surfaces, at a time, of an object to be coated with the black primer so that the time required for application may be reduced. This holds true irrespective as to whether the object is a flat board or a columnar body. The flow of the paint can be so easily subjected to a precise control that the paint can be applied uniformly and stringiness or trickling of the paint does not occur when the paint has been applied to the surfaces of the object.

Instead of two paint-coating felt elements 23 attached to the upper and lower members respectively, a paint-coating felt element may be in the form of a unitary structure which includes two plane surface coating portions 34 and an end face coating portion 35 adapted to be pressed against and moved along the upper surface F1, lower surface F2 and end face F3 of the quarter window glass QG. The shape of the paint-coating felt elements 23 may be varied or altered according to the contour of the object to be coated with the paint and according to the number of surfaces to be coated with the paint. For example, when only the upper surface F1 and the end face F3 of the quarter window glass QG have to be coated with the paint, the paint-coating member may be provided only with the upper paint-coating felt element 23, the end face coating portion 35 of which has such a dimension l1 as to be equal to or larger than the thickness t1 of the quarter window glass QG. If the object to be coated with the paint has a curved surface, either or both of the portions 34 and 35 have only to conform closely to the curved surface. The curved surface may be divided into several parts, to each of which a paint-coating felt element 23 is allowed to correspond. The whole peripheral surface of a columnar body may be covered with a plurality of paint-coating felt elements 23. In these cases, the shape of the paint-supplying felt element 52 will have to be varied or altered. The paint-supplying felt element 52 may be made of a material different from that of which the paint-coating felt element 23 is made. The present invention is applicable not only to the application of the black primer BP but also to the application of other various paints such as a coating material or adhesive.

The above-described fluid flow lines of the paint-supplying apparatus 3 may also be varied or altered. For example, air can be made cleaner if a two-stage filter consisting of coarse- and fine-filtering components is used in place of the automatic drain filter 84. A change-over valve, which can be used as a relief valve when excessive pressures are encountered, may be installed in the air line LN5.

The construction, shape and disposition of the paint-coating installation 2, paint-supplying apparatus 3, conveyer 4, paint-coating robot 5, paint-coating unit 11, paint-supplying member 12, paint-coating members 13 and other components of the above-described preferred embodiment may be varied or altered without departing from the spirit of the present invention and the scope of the appended claims.

We claim:

1. A method for applying a paint employing:

paint-coating members provided respectively with main bodies which can open and close;

a paint-coating means provided on each of said main bodies, said paint-coating means, which is made of elastic material and soaked with paint, being provided with coating portions which are contoured so as to conform with coating surfaces of an object that is to be coated with said paint;

a means for supplying paint, said means being provided with a paint-supplying means which is soaked with said paint; and a manipulator which moves said paint-coating members; and wherein said method comprises the steps of:

moving said paint-coating members via said manipulator so that said paint-supplying means is positioned between said coating portions;

closing said paint-coating members and pressing said coating portions against said paint-supplying means so that said paint-coating means is soaked with said paint;

opening said paint-coating members;

moving said paint-coating members via said manipulator so that said coating surfaces of said object are positioned between said coating portions;

closing said paint-coating members; and moving said paint-coating members via said manipulator so that said coating portions move along said surfaces.

2. An apparatus for applying a paint comprising:

paint-coating members provided respectively with main bodies which can open and close;

a paint-coating means provided on each of said main bodies, said paint-coating means, which is made of elastic material and soaked with paint, being provided with coating portions which are contoured so as to conform with coating surfaces of an object that is to be coated with said paint;

a means for supplying paint, said means being provided with a paint-supplying means which is soaked with said paint; and a manipulator which moves said paint-coating means so that said means for supplying paint is positioned between said coating portions and so that said coating portions are moved along said coating surfaces.

3. An apparatus for supplying a paint to a paint coating means in which:

a main body formed in U-shape is provided; and a groove is formed on an inner surface of said main body; and wherein said main body is provided with:

a plurality of orifices opened on a top surface of said groove; and a port communicated to said orifices; wherein a paint-supplying means of plate like form which is soaked with paint is attached to said groove, said paint-supplying means being provided with an exposed portion with which said paint-coating means come in contact; and a paint supplying apparatus through which paint is pressure transferred is connected to said port and paint supplied through said port flows out of said orifices and permeates into said paint-supplying means and disperses so that said paint permeates into said paint-coating means via said exposed portion which is in contact with said paint-coating means.

4. An apparatus for supplying a paint to a paint-coating means in which:

a main body formed in U-shape is provided; and a groove is formed on an inner surface of said main body; and wherein said main body is provided with:

a plurality of orifices opened on a top surface of said groove; and a port communicated to said orifices; wherein a paint-supplying means of plate-like form which is soaked with paint is attached to said groove, said paint-supplying means being provided with an exposed portion with which said paint-coating means comes into contact with;

a paint-supplying apparatus through which paint is pressured transfer is connected to said port and paint supplied through said port flows out of said orifices and permeates into said paint-supplying means and disperses so that said paint permeates into said paint-coating means via said exposed portion which is in contact with said paint-coating means; and a thickness of said paint-supplying means is substantially equal to thickness of said object to which application of said paint is performed by said paint-coating means.

* * * * *